US005241733A

United States Patent [19]

Rosen

[11] Patent Number: 5,241,733

[45] Date of Patent: Sep. 7, 1993

[54] METHOD OF MAKING A CLOTH CUTTER BRISTLE BED FROM ELONGATE SUPPORT MEMBERS

[75] Inventor: Fredric K. Rosen, Weston, Conn.

[73] Assignee: Geber Garment Technology, Inc., Tolland, Conn.

[21] Appl. No.: 895,799

[22] Filed: Jun. 9, 1992

Related U.S. Application Data

[62] Division of Ser. No. 757,448, Sep. 10, 1991, abandoned.

[51] Int. Cl.[5] ..... B26D 7/20

[52] U.S. Cl. ..... 29/416; 29/418; 83/451; 83/941; 269/21; 269/289 R

[58] Field of Search ..... 83/451, 939, 941; 29/416, 418; 269/21, 53, 289 R

[56] References Cited

U.S. PATENT DOCUMENTS

| | | | |
|---|---|---|---|
| 780,298 | 1/1905 | MacCarthy | 15/215 |
| 2,929,088 | 3/1960 | Wier | 15/181 X |
| 2,949,651 | 8/1960 | Hill | 15/250.41 X |
| 2,980,467 | 4/1961 | Lechene | 15/182 X |
| 3,233,272 | 2/1966 | Pambello | 15/182 |
| 3,312,583 | 4/1967 | Rochlis | 428/88 |
| 4,029,834 | 6/1977 | Bartlett | 428/62 |
| 4,205,835 | 6/1980 | Gerber | 83/451 X |
| 4,221,833 | 9/1980 | Guillermin et al. | 428/92 |
| 4,633,903 | 5/1987 | Ellingson, Jr. | 52/181 |
| 4,685,363 | 8/1987 | Gerber | 83/451 X |
| 5,001,954 | 3/1991 | Andrada Galan et al. | 83/451 |

FOREIGN PATENT DOCUMENTS 1211755 3/1960 France .

*Primary Examiner*—Frank T. Yost
*Assistant Examiner*—Clark F. Dexter
*Attorney, Agent, or Firm*—McCormick, Paulding & Huber

[57] ABSTRACT

A method of making a cloth cutter knife permeable bed formed from a plurality of elongate support members, preferably plastic extrusions, which provides a permeable support surface in a cloth cutting machine upon which a lay-up is supported for cutting by a cutter head. The extrusions are cut up by the reciprocated knife of the cutter head to form a multiplicity of bristles which after subsequent cutting operations of the lay-up create a dense knife permeable bristle bed for supporting the layup in a generally flat manner.

12 Claims, 5 Drawing Sheets

METHOD OF MAKING A CLOTH CUTTER BRISTLE BED FROM ELONGATE SUPPORT MEMBERS

This is a divisional of co-pending application Ser. No. 07/757,448 filed on Sep. 10,1991, now abandoned.

This invention relates to an apparatus for cutting a layup of cloth or other similar sheet material spread over a support surface in a cutting machine, and deals more particularly with a knife permeable bed formed from a plurality of elongate support members each having at least one generally upwardly extending web portion for supporting the layup such that during a cutting operation of the layup, the upper edges of the web portions collectively create a support surface for the layup yet allow the tip of the reciprocating knife in the cutter head to be maintained below the support surface as the knife is moved forwardly along a path of cut.

In known cutting machines for cutting closed shapes in a ply or a stack of plies of fabric or other like material which may comprise a layup to be cut, a coordinate controlled cutter head is moved above a support surface supporting the layup through which surface a reciprocating knife in following a predetermined path therealong plunges such that its lower tip is reciprocated below the support surface in order to fully cut the layup supported thereon. Since the individual material sheets which may comprise the layup are normally limp, it is preferable to compress them together during the cutting operation onto the bed of the cloth cutter to create a rigid stack of material in order that the reciprocating cut through the layup as it would do to a unitary piece of material. For this purpose, a vacuum source is provided is applied to the bed thereby compressing the layup material downwardly against the bed thus rigidifying the material stack during the cutting operation. Previously known cloth cutting machines employing air permeable beds have used a plurality of preformed bristle blocks comprised of a multiplicity of upstanding needles each ending in a tip coplanar with one another and with those needles of other blocks when assembled together on the machine adjacent one another to define the support surface of the bed. Such bristle blocks are usually formed by a molding process with the end result being molded preforms each having a substantially square base portion from which the multiplicity of bristles or needles extend upwardly. The square base portions are further formed with openings communicating with the needles of each block allowing a vacuum to migrate longitudinally and laterally through the needles to distribute the vacuum evenly. One such type of bristle block system is disclosed in U.S. Pat. No. 4,205,835 issued on Jun. 3, 1980 to H. Joseph Gerber, which patent being commonly assigned with the assignee of the present invention. While support beds of this type have been successful, it has been found that molding each of the blocks is somewhat costly and ultimately requires a substantial expenditure of time in assembling the many blocks on the table in a grid-like configuration.

Accordingly, it is the general object of the present invention to provide a low-cost permeable bed in a cloth cutter capable of being readily assembled so as to provide a support surface thereon allowing a layup of sheet material to be supported below a cutter head in a generally flat manner while nevertheless permitting the lower reciprocated tip of the cutter head knife to penetrate and be maintained below the support surface during a cutting operation. In keeping with this object, a more particular object is to provide a cutter bed particularly well suited to be cut up by the cutter head knife thus forming a multiplicity of bristles so arranged on the cloth cutter as to allow a vacuum to migrate longitudinally and lateraly through the bristles to compress the layup and hold it in place on the bristle-like support surface for cutting during a cutting operation.

It is still a further object of the present invention to provide a bed made from a plurality of inexpensive, elongate plastic extrusions each having sufficient stiffness in compression after being cut-up by the reciprocating knife of the cutter head to form bristles for supporting the layup in a generally flat manner urged in this way by the downward force applied to the layup by a vacuum source.

Other objects and advantages of the present invention will become apparent from the following disclosure and the appended claims.

SUMMARY OF THE INVENTION

The present invention resides in a permeable cutter bed capable of being readily assembled in a cloth cutting machine for supporting engagement with a layup of sheet material above which bed a coordinate controlled cutter head having a reciprocating knife moves relative thereto for cutting a desired path in the layup during a cutting operation.

The cutter bed is formed from a plurality of elongated support members each respectively mounted on a table in a side-by-side manner through the intermediary of mounting elements connecting the elongate support members to the table in a laterally spaced relationship. The mounting elements together with the top surface of the table define a plurality of longitudinally oriented, spaced apart channels for securably receiving an associated support member therein. The support members each have at least one web portion extending upwardly from an integrally connected lower base portion received within an associated one of the channels formed in the bed. Each web portion extends generally upwardly from its base portion, with the base portion of each member being so sized and shaped as to be received within a respective one of the channels formed by opposed ones of the mounting elements and the table surface thereby orienting the upper edges of each web portion generally coplanar with one another to define a support surface upon which the layup is placed. Means are provided in the bristle bed for introducing a vacuum source confluent throughout the bed area and includes a series of openings formed in the table and in the mounting elements for drawing air from the bed for the purpose of compacting the layup placed on the bed during a cutting operation.

The invention further resides in a method whereby a plurality of elongate plastic extrusions are provided as the support members and are assembled onto the bed in an uncut state. Prior to placing a layup on the bed, the cutting machine conditions the extrusions by causing the cutter head with its knife lowered into engagement with the extrusions to move transversely of each extrusion length to generally coarsely cut up the bed to form a multiplicity of bristles therealong whose edges together define a generally flat workpiece support surface upon which the layup is supported during a cutting operation. Subsequent to this, the layup is placed down onto the conditioned bed whereupon the cutter head knife with its tip plunged through the layup and downwardly beyond the workpiece support surface is moved along a predetermined path of cut ultimately resulting in the cutting of a shape in the layup and in turn further conditioning the bed as the web portions are cut into finer pieces which eventually forest with one another thereby creating the likeness of a dense bristle bed.

Different configurations for the extrusions may be provided ranging from one having a single upstanding web portion tapering upwardly from its base portion to one having five such web portions the middle of which being a generally vertically upstanding one with the remaining four flared outwardly relative to it and extending generally upwardly from the associated base portion.

Figure 1:
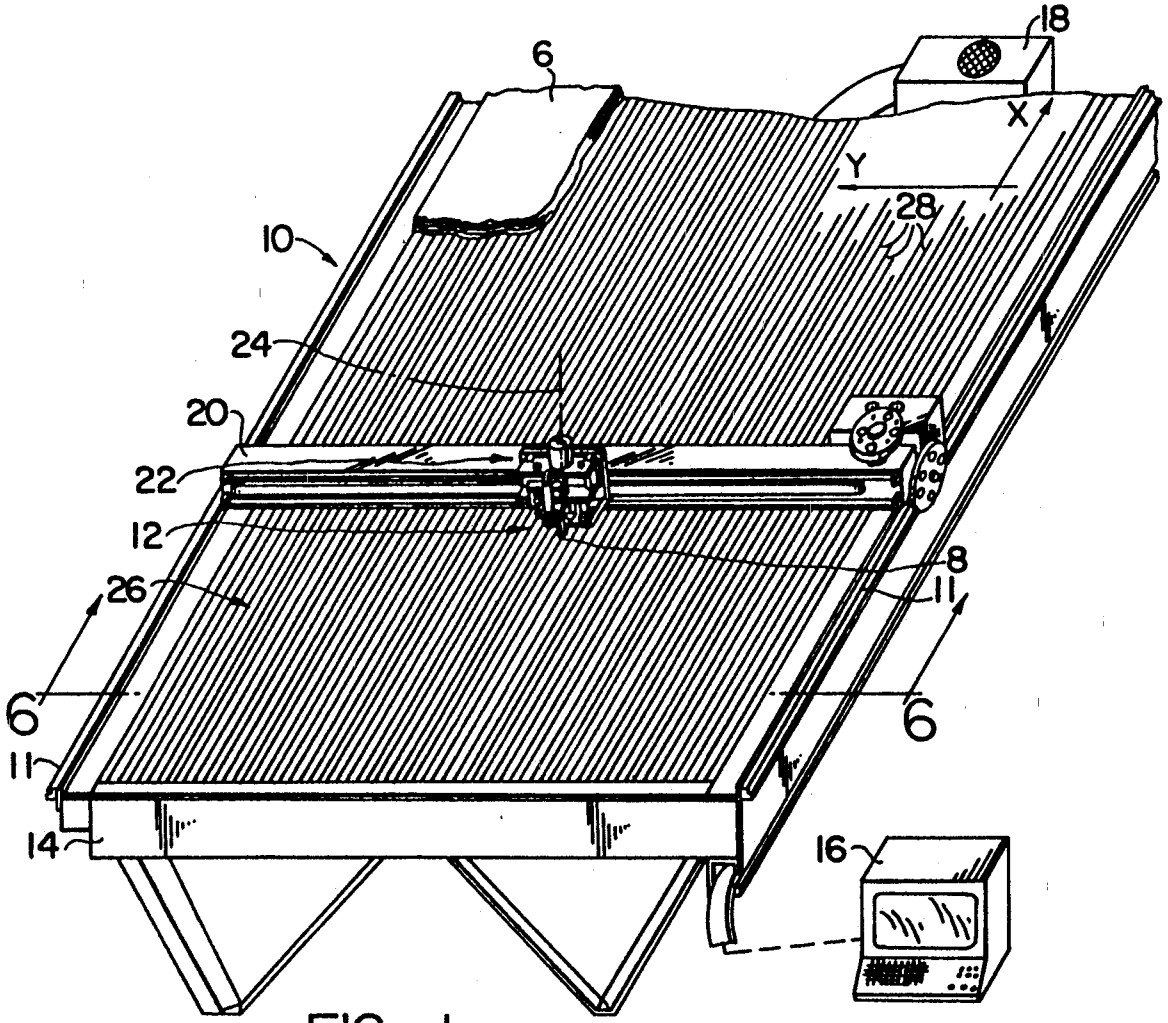
FIG. 1 is perspective view showing a cloth cutting machine in which is embodied the present invention.

FIGS. *7a*, *7b* and *7c* illustrate three alternate embodiments of the support elements which may be employed in the cutting machine of FIG. 1.

DETAILED DESCRIPTION OF THE EMBODIMENTS

FIG. 1 shows a cloth cutting machine 10 embodying the invention and having a cutter head 12. In addition to the cutter head 12, the machine includes a cutting table 14 and a controller 16 having a central processing unit and memory for directing the movements of the cutter head 12 relative to the cutting table 14. The table 14 is generally rectangular presenting a sufficient area for supporting a workpiece, such as a layup 6 comprised of a plurality of sheets of limp material, in a substantially flat manner. The table 14 also includes an associated vacuum system which includes a vacuum source 18 for holding in place and compacting the layup 6 during a cutting operation.

The cutter head 12 is moved above the table 14 along the indicated X and Y coordinate axes on a X-carriage 20 traveling along two guides 11,11 each disposed along either side edge of the table 14 and is moved along the Y-axis by a Y-carriage 22 in turn traveling on the X-carriage such that the combined coordinated movements of the X and Y carriages, effected by appropriate motor drive means linked to the controller 16, move the cutter head 12 along a predetermined path. The cutter head 12 further includes a knife 8 having a depending tip capable of being moved downwardly through the layup 6 and reciprocated to cut a shape in the layup 6 in a manner that will hereinafter become apparent in accordance with one aspect of the invention. The knife 8 is further capable of angular movement about a theta axis 24 to provide additional control of its leading edge along a preset path of cut in response to preprogrammed conditions set by the controller 16.

Figure 2:
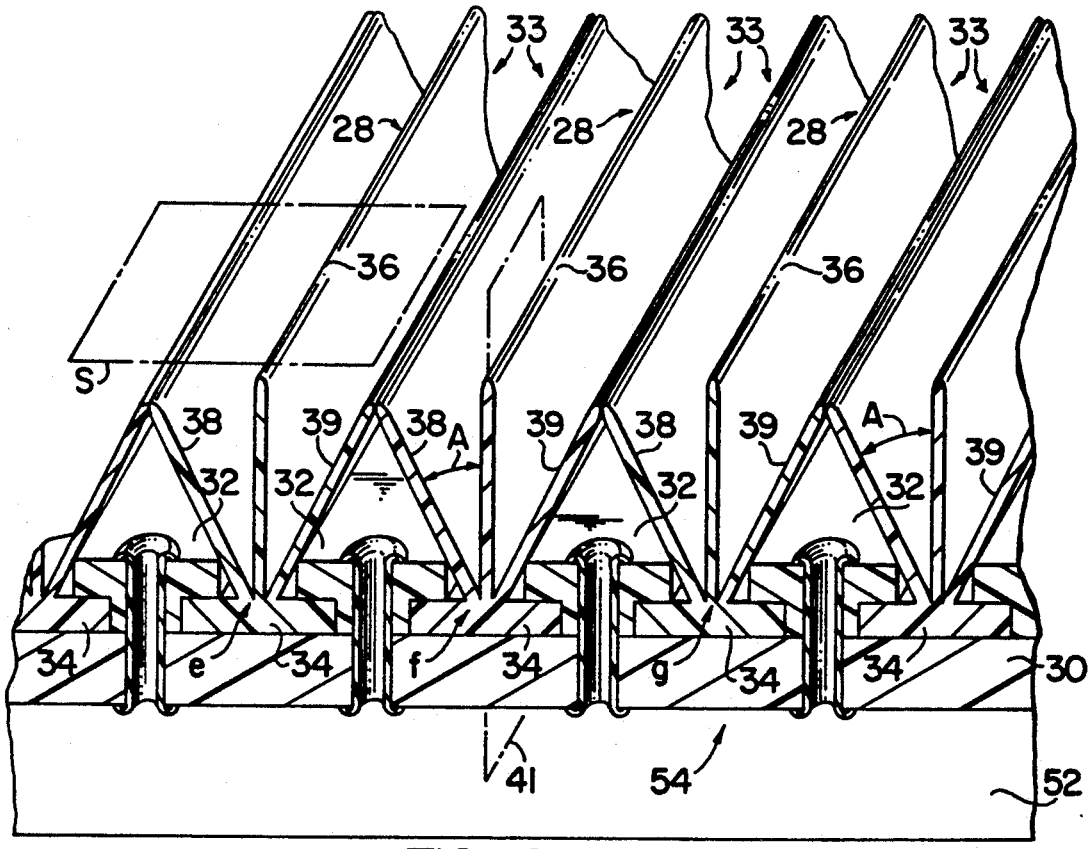
FIG. 2 is a fragmentary perspective view of a portion of the cloth cutter of FIG. 1 showing the support members arranged in rows on the machine.

In accordance with the invention, a knife permeable bed 26 is provided on the machine 10 and includes means for creating a readily assembled workpiece support surface S on the table 14 for supporting the layup 6 in a generally flat manner below the cutter head 12 such that the layup may be cut through by the reciprocating knife 8 along a predetermined path during a cutting operation. While cutting the layup 6 in this manner, the knife 8 is reciprocated such that with each stroke, its tip is maintained within the bed 26 and below the support surface S thereby insuring that full cutting of the material making up the layup 6 is effected. The bed 26 as shown in greater detail in the illustrative example of FIG. 2, is comprised of a plurality of elongate support members 28,28 arranged side-by-side with one another in parallel spaced apart rows. For this purpose, the table 14 at its upper extent includes a base plate 30 to which each of the support members 28,28 is connected through the intermediary of a plurality of elongate laterally spaced apart mounting elements 32,32 securably attached to the base plate 30 by suitable securing means hereinafter discussed in accordance with one aspect of the present invention. The upwardly directed free ends of each of the support members 28,28 define edges 33,33 lying generally coplanar with one another so as to collectively define the substantially even support surface S for supporting the layup 6 thereon.

In one example of the preferred embodiment as illustrated in FIG. 2, each support member 28,28 is defined by a lower base portion 34 integrally connected with a generally vertical first web portion 36 extending generally upwardly from its base portion and being further defined by a second web portion 38 and a third web portion 39 each respectively disposed on either side of the first web portion 36 and each together being integrally connected with one another and to the first web portion 36 through the base portion 34. The first web portion 36 is oriented coincidentally with the central plane 41 of each support member 28,28, with the and third web portions 38 and 39 being angularly disposed relative to this plane at an angle indicated as A in FIG. 2 equal to between 30 and 45 degrees. As between successive side-by-side support members 28,28, for discussion purposes indicated as e, f and g in FIG. 2, it should be seen that the second web portion 38 of one member f is disposed generally adjacent the third web portion 39 of another member e while the third web portion of the one member f is disposed generally adjacent the second web portion 38 of the next elongate member g proceeding away from the another elongate member e. Although the second and third web portions in each support member flare outwardly taken from each base portion 34 and proceeding upwardly therefrom, each of these web portions has a sufficient length dimension such that its associated upper edge 33 lies substantially in the same horizontal plane as that of the first web portion 36 to thereby define the workpiece support surface S.

Figure 3:
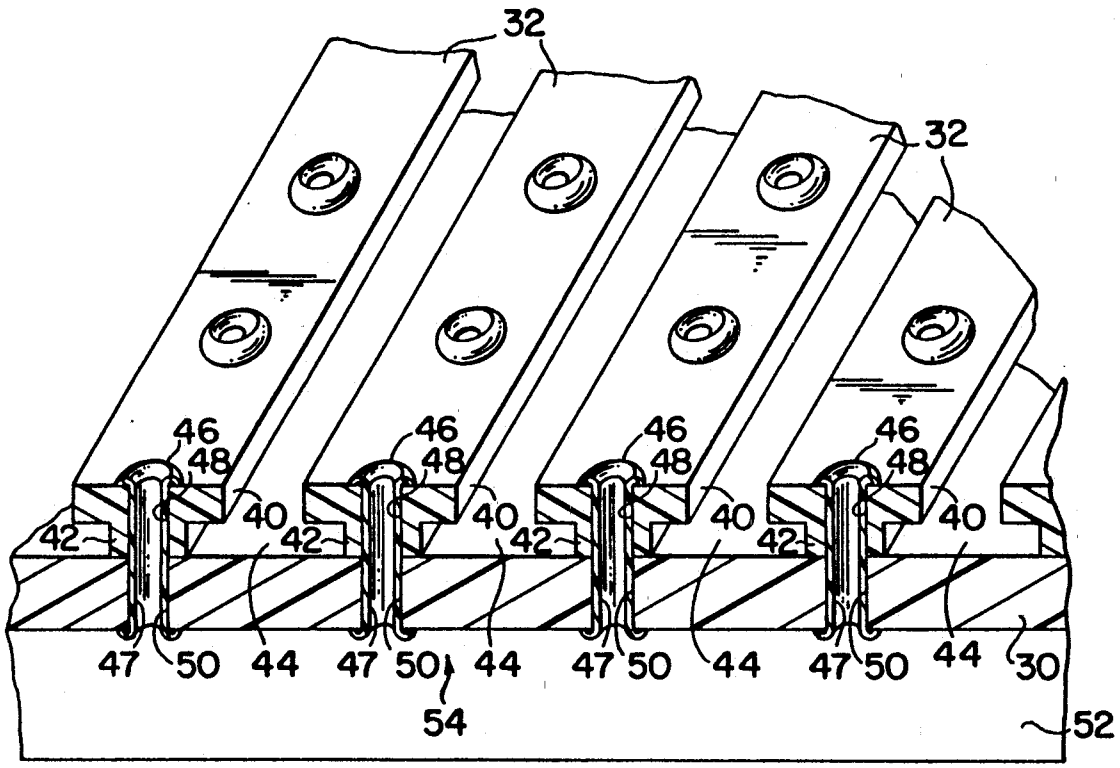
FIG. 3 is a fragmentary perspective view of a portion of the cloth cutter bed of FIG. 1 without the support members of FIG. 2 in place.

Referring now FIG. 3 and to the means by which the elongate support members 28,28 are connected to the table 14 for supporting engagement with the layup 6, it should be seen that the base portion 34 of each support element 28,28 is correspondingly sized and configured to be received between opposed pairs of the mounting elements 32,32. For this purpose, each of the mounting elements has a generally T-shaped configuration defined by a horizontal flange 40 and a connecting portion 42 depending therefrom such that the oppositely facing sides of opposed mounting element pairs together with the upper surface of the base plate 30 define channels 44,44 for receiving in holding engagement therewith, the correspondingly shaped and sized base portion 34 of an associated one of the support members 28,28.

For connecting the mounting elements 32,32 to the base plate 30, securing means 46,46 are provided and further include means for allowing air to be drawn through the bed 26 by the vacuum source 18. To this end, the securing means 46,46 are comprised of a plurality of hollow fasteners having through tubular portions 47,47 the outer extent of which being received within aligned openings 48 and 50 respectfully formed in the mounting elements 32,32 and in underlying portions of the base plate 30. Spaced from and below the base plate 30 is provided a closure member 52 defining a chamber 54 in the table 14. This chamber is in communication with the vacuum source 18 and through the intermediary of the tubular portions 47,47 of the fasteners 46,46 is also in communication with the bed 26 thereby allowing the even distribution of vacuum throughout the bed 26 as necessary to compact the layup 6 during a cutting operation.

The support members 28,28 are particularly well constructed to be conditioned by the cutter head knife 8 to collectively form the general likeness of a bristle bed. For this, the support members 28,28 are preferably formed from elongate plastic extrusions, the webs of which are capable of being readily cut by the knife 8 when the controller 16 causes the cutter head 12 to lower the knife 8 into the bed 26 such that the bottom of each stroke lies substantially below the support surface S. As illustrated by the phantom line path 58' in FIG. 4, the reciprocated knife 8 may thereafter be moved forwardly across the bed 26 along a path tracking generally transversely to the longitudinal extent of each of the support members 28,28. As a result, a series of serrations indicated at 56,56 in FIG. 5 are consequently cut in the web portions of each of the support members at spaced apart intervals along each web portion length thereby creating a multiplicity of generally coarse bristles 57,57 for supporting the layup 6 thereon in the illustrated manner. Alternatively, the coarse bristles 57,57 may be initially formed as the result of cutting the support members as part of their manufacturing process such that the installed support members have the serrations 56,56 already formed in them. The rather coarse bristles now making up the web portions of each support member installed on the table collectively are still sufficiently stiff in compression to support the layup 6 in the illustrated generally planar orientation even with the vacuum source applied.

Figure 6:
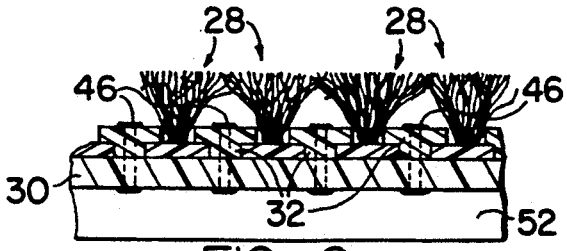
FIG. 6 is a partially fragmentary view taken along line 6—6 of FIG. 1 showing the cutter bed after continuous cutting operations.
Figure 4:
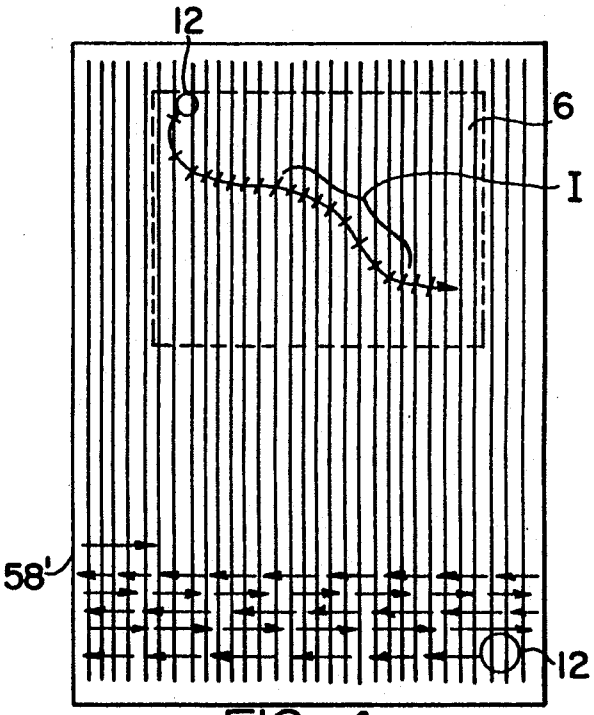
FIG. 4 is a top view of the cutter bed shown schematically illustrating in phantom line, a portion of the path taken by the cutter head during the conditioning step and further illustrates in full line, a path taken by the cutter head while cutting a shape in a layup during a cutting operation.
Figure 5:
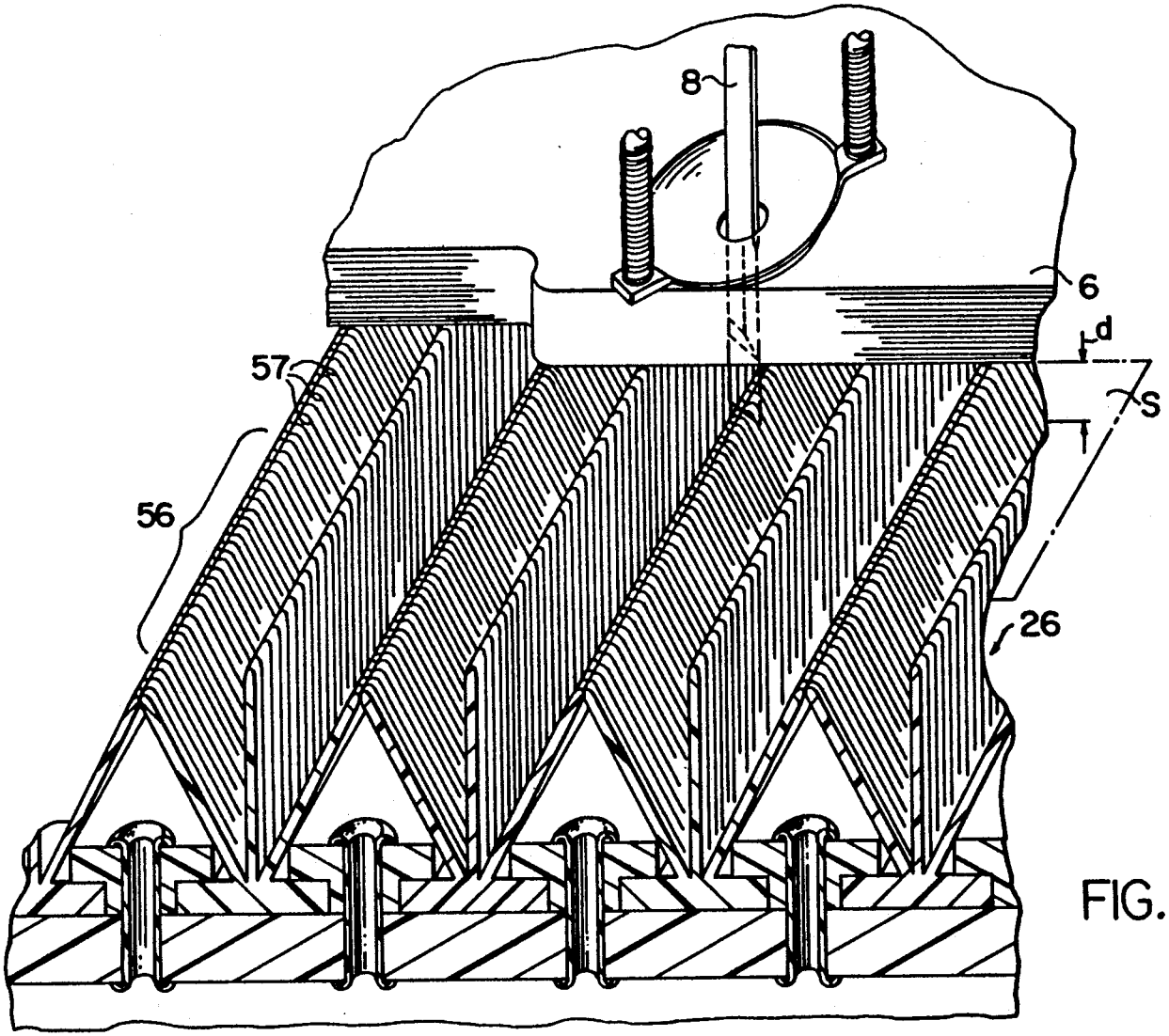
FIG. 5 is a partially fragmentary perspective view of the cutting machine of FIG. 1 showing the cutter head cutting a lay-up supported on the cloth cutter bed during a cutting operation.

Referring now to the full line path 62 shown in FIG. 4, it should be seen that the path 62 is representative of one which may be followed by the cutter head 12 during subsequent cutting operations of the layup 6 to effect cutting of a shape or pattern in the layup 6. Here, the combined reciprocated and forward movements of the knife 8 in following such a path cause additional and finer cuts to be made in the already coarsely cut-up web portions of the support members 28,28. That is, while cutting the layup 6 along the path 62 the tip of the knife 8 is reciprocated and maintained below the bed 26 by a depth indicated by dimension d in surface S of the bed 26 by a depth indicated by dimension d in FIG. 5 such that the rather coarse bristles 57,57 initially formed by the serrations 56,56 made in the conditioning operation, are further more finely cut during such subsequent cutting operations of the layup by the vector component of the knife path intersecting with each web portion at the indicated juncture marks I shown in FIG. 4. This results in the bristles eventually becoming forested with one another thereby taking on the similarity of a dense bristle bed with continued use of the machine as can be appreciated by the view shown in FIG. 6. Additionally, the dense bristle bed likeness enables the vacuum to communicate through the hollow fasteners 46,46 and migrate longitudinally and laterally through the bristles to distribute the vacuum evenly throughout.

In summary, it should be seen that the elongate support members 28,28 are in the preferred embodiment formed from inexpensive extruded material, such as plastic or the like, which members are readily and easily assembled on the table 14 as uncut pieces received within the channels 44,44 formed by the cooperative surfaces of opposed ones of the mounting elements 32,32 and the base plate 30. The hollow fasteners 46,46 secure the mounting elements to the base plate 30 and allow the vacuum source 18 to be confluent with the bed 26 through the intermediary of the tubular portion of each fastener. For conditioning the extrusions to cause serrations to be formed therealong prior to the first cutting operation of a layup, the reciprocating tip of the cutter head knife is lowered below the support surface S and moved forwardly transversely of the longitudinal extent of each web portion to form generally coarse bristle elements therefrom. In subsequent cutting operations of a layup placed down onto the surface S now defined by the upper edges of the rather coarsely cut web portions, the reciprocated knife further engages with these coarsely cut bristles to additionally cut them into finer foresting pieces creating the likeness of a dense bristle bed upon which the layup is supported. Accordingly, the previously known practice of forming preformed individual bristle blocks from processes, such as molding, are herein avoided as well as the practice of assembling these preformed bristle blocks in a grid-like manner on the table.

Figure 7A:
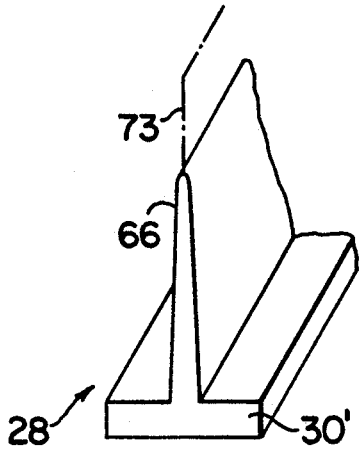
Figure 7B:
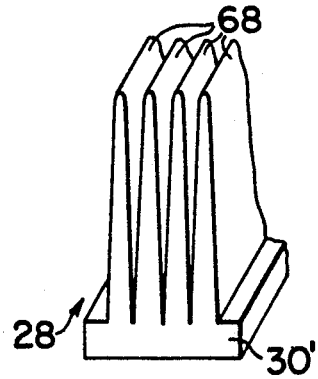
Figure 7C:
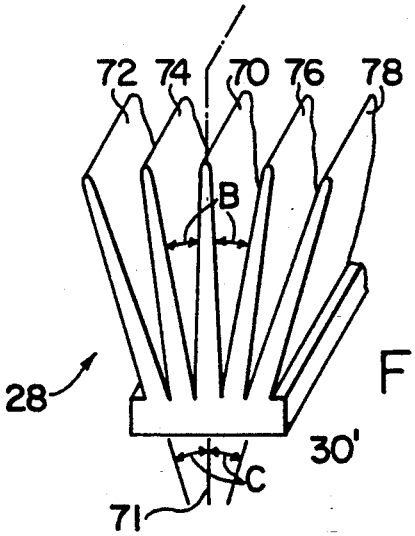

In FIGS. 7*a* through 7*c*, three embodiments of different configurations for the support members 28,28 are illustrated, each of which may alternatively be employed in the cutter bed 26 in place of the configuration of those shown in FIGS. 2 and 5. In FIG. 7*a*, the elongate support member 28 has a base portion 30' from which a single web portion 66 tapers upwardly. Here, the single web portion 66 is oriented coincidentally with the central plane 73 of the elongate member and the web itself is singly more substantial in thickness than those found in other constructions in which a plurality of web portions extend from the base portion. Similarly, in the embodiment of FIG. 7*b*, four generally parallel vertically disposed web portions 68,68 are integrally connected with the base portion 30' such that each web portion has a uniform length tapering upwardly therefrom and ending in an edge coplanar with one another to define a surface upon which the layup 6 is supported.

In the embodiment shown in FIG. 7*c*, there is shown a support member 28 having five web portions each extending upwardly from the common base portion 30'. A generally vertically oriented central web portion 70 is positioned substantially coincidentally with the central plane 71 of the support member and disposed laterally on either side of the central web portion 70 are two angularly disposed web portion pairs. The first such pair being defined by a second web portion 72 and a third web portion 74 and the second such pair being defined by a fourth web portion 76 and a fifth web portion 78. These web portions are arranged on the base portion 30' such that the third and fourth web portions 74 and 76 are disposed at a first angle B taken relative to the plane 72 and the respectively more outwardly disposed second and fifth web portions 72 and 78 being disposed at a second angle which angle being greater than that of the first angle B. In addition, it should be understood that when mounted to the table 14 in rows, such as shown in FIG. 1, the web portions of each support member shown in FIG. *7c* are dimensioned such that their upper edges lie coincidentally in the same horizontal plane with one another and that as between consecutively oriented support members, the second web portion of one member is positioned generally adjacent the fifth web portion of another member and the fifth web portion of the one member is positioned generally adjacent the second web portion of the next succeeding support member proceeding away from the another member.

While the present invention has been described in the preferred embodiment, it should be understood that numerous modifications and substitutions can be had without departing from the spirit of the invention. For example, although the support members 28,28 are disclosed as preferably being formed from a plastic material, they could alternatively be formed from another stiff suitable cuttable material, such as cardboard. Also, the hollow fasteners 46,46 are disclosed as connecting the mounting elements 32,32 with the base plate 30. However, it is entirely within the scope of the present invention to connect the mounting elements to the base plate 30 using solid bolts and to form separate through openings in the mounting elements 32,32 and in portions of the base plate 30 in places other than along points of securement at sufficiently spaced apart intervals for evenly communicating a vacuum source with the bed 26.

Accordingly, the present invention has been described by way of example rather than limitation.

I claim:

1. A method of making a cutter bed having a multiplicity of bristles for providing a workpiece support surface in a cutting machine of the type having a cutter head with a reciprocating knife moveable relative to said cutter bed along two coordinate axes, said method comprising:

providing a substantially flat work table;

providing a plurality of elongate support members each having a base portion and at least one web portion extending generally upwardly therefrom, said at least one web portion at the upper end thereof ending in at least one edge;

arranging said elongate support members in rows on said substantially flat work table such that the edges of said web portions are capable of collectively supporting a layup thereon in a generally horizontal plane;

providing said plurality of elongate support members such that each member has a given length, said given length being defined as running parallel to said generally horizontal plane, the at least one web portion and the base portion of each elongate support member being equal to and continuous with the given length when initially arranged on said work table; and forming a series of serrations along the at least one web portion of each of said elongate support members such that when said plurality of elongate support members are arranged on said work table the edges of said elongate support members are substantially aligned with one another to present a generally even workpiece support surface defined by a multiplicity of bristles capable of collectively supporting a layup during a cutting operation.

2. A method as defined in claim 1 further characterized by utilizing the reciprocating knife of said cutter head to cut up said support members to form aid series of serrations therein in a conditioning step wherein a tip of the knife is reciprocated below said workpiece support surface and thereafter is moved transversely across the cutter bed relative to the longitudinal extent of each of said support members in a path proceeding from an end of said work table toward a second thereby forming said serrations.

3. A method as defined in claim 2 further characterized by placing a layup down upon the conditioned support members after said serrations have been made; and further cutting said support members into finer bristles during cutting of the layup such that the multiplicity of bristles eventually forest with one another and create the likeness of a dense bristle bed.

4. A method as defined in claim 1 further characterized by providing said work table with a base plate and arranging said support members in rows on said base plate and providing passages in said base plate between each support member row;

said passages being confluent with a vacuum source for compacting said layup down onto said bed during a cutting operation.

5. A method as defined i claim 4 further characterized by providing mounting elements between each support member row to mount each support member to the base plate in a spatial relationship with one another; and securing each of said mounting elements to said base plate such that said passage are coincident with securing means.

6. A method as defined in claim 5 further characterized by providing said support members in the form of plastic extrusions each having a single web portion tapering in vertical cross-section from its base portion to its upper edge.

7. A method as defined in claim 1 further characterized by providing said support members in the form of plastic extrusions each having first, second, and third web portions integrally connected with said base portion;

orienting said first web portion generally coincidentally with the central plane of said extrusion; and orienting said second and third web portions on opposite sides of said first web portion and disposing each of said second and third web portions at an angle relative to said first web portion.

8. A method as defined in claim 7 further characterized by orienting said extrusions on said work table such that the second web portion of one extrusion is positioned generally adjacent the third web portion of an adjacent extrusion and the third web portion of said one extrusion being positioned generally adjacent the second web portion of the next successive extrusion proceeding away from said adjacent extrusion.

9. A method as defined in claim 8 further characterized by orienting said second and said third web portions relative to said first web portion at an angle between approximately 30 and 45 degrees.

10. A method as defined in claim 1 further characterized by providing said support members in the form of plastic extrusions each having five web portions integrally connected with one another at said base portion; and arranging one of said web portions vertically with reference to the remaining four web portions such that the remaining four web portions extend upwardly from the base portion at an angle taken relative to the vertically disposed web portion.

11. A method as defined in claim 1 further characterized by cutting each of said elongate support members to form said series of serrations therein.

12. A method of making a cutter bed having a multiplicity of bristles for providing a workpiece support surface in a cutting machine of the type having a cutter head with a reciprocating knife moveable relative to said cutter bed along two coordinate axes, said method comprising:

providing a substantially flat work table having two ends;

providing a plurality of elongate support members each having a base portion and at least one web portion extending generally upwardly therefrom and ending in an edge;

arranging said plurality of elongate support members on said substantially flat work table such that the edges of said elongate support members are substantially aligned with one another to present a generally even workpiece support surface; and forming a series of serrations along the at least one web portion of each of said elongate support members such that said generally even workpiece support surface is defined by a multiplicity of bristles capable of collectively supporting a layup during a cutting operation;

wherein said series of serrations are formed by; such that the edges of said elongate support members are substantially aligned with one another to present a generally even workpiece support surface; and utilizing the reciprocating knife of said cutter head to cut up said support members in a conditioning step wherein a tip of the knife is reciprocated below said workpiece support surface and thereafter is moved transversely across the cutter bed relative to the longitudinal extent of each of said support members in a path proceeding from one end of said work table toward the other thereby forming said serrations.

* * * * *